US007765945B2

(12) United States Patent
Radcliff

(10) Patent No.: US 7,765,945 B2
(45) Date of Patent: Aug. 3, 2010

(54) WATERCRAFT LIFT STABILIZING SYSTEM AND ACCESSORIES THEREFOR

(76) Inventor: Tracy Radcliff, 3301 S.E. Slater St., Stuart, FL (US) 34997

( * ) Notice: Subject to any disclaimer, the term of this patent is extended or adjusted under 35 U.S.C. 154(b) by 0 days.

(21) Appl. No.: 11/882,648

(22) Filed: Aug. 3, 2007

(65) Prior Publication Data

US 2008/0105181 A1 May 8, 2008

(51) Int. Cl.
*B63C 7/00* (2006.01)
*B63C 3/02* (2006.01)

(52) U.S. Cl. ..... 114/44; 405/3

(58) Field of Classification Search ..... 114/44; 405/3–7

See application file for complete search history.

(56) References Cited

U.S. PATENT DOCUMENTS 6,554,533 B2 * 4/2003 Godbersen ..... 405/3
6,837,651 B1 * 1/2005 Basta ..... 405/3
6,976,806 B2 * 12/2005 Edson ..... 405/3

* cited by examiner

*Primary Examiner*—Daniel V Venne
(74) *Attorney, Agent, or Firm*—The Nath Law Group; Derek Richmond; Stanley N. Protigal

(57) ABSTRACT

This document is directed toward a stabilizing system that is engageable with a watercraft lift assembly. The system includes a piling bracket, at least one piling bracket keyhole in the piling bracket, a lift-block having at least one keyhole pin extending from a first side of said lift-block toward said at least one piling bracket keyhole, and a stabilizing beam, for supporting a watercraft lift assembly cradle. The stabilizing beam is attached to a second side of said lift-block.

13 Claims, 22 Drawing Sheets

WATERCRAFT LIFT STABILIZING SYSTEM AND ACCESSORIES THEREFOR

FIELD OF THE INVENTION

The disclosed apparatus is directed to stabilize a boatlift in storm situations and to lock the boatlift to prevent theft.

BACKGROUND

Most common boatlifts consist of a cradle supported by four cables mounted to a top beam with a gear unit, which drives a pipe thereby winding the cable and lifting the boat. Further, in the most common water-lifts for boats, a boat cradle is swing-mounted on two pairs of parallel link units which are in turn swing-mounted on a base frame. A hydraulic cylinder unit, comprising a lift cylinder, piston, and piston rod, is mounted between the base frame and one of the parallel link units so that extension of the piston rod from the lift cylinder causes the parallel link units and cradle to swing upwardly. The lift cylinder is supplied with pressurized water from any convenient source to raise the lift and is lowered by emptying the cylinder.

In the past, the boat cradle has usually been held in position by one or the other of two arrangements, and namely, by raising the parallel linkage past center (past a vertical position) to engage a stop, or by latching the lift cylinder unit such that its piston rod cannot retract relative to its cylinder. Such latching has been accomplished by a dog swing-mounted on the upper end of the lift cylinder and arranged to swing down by gravity into locking engagement with a stop when the desired elevation of the boat cradle has been reached. However, no attempt to stabilize the cradle against forces caused by high winds or other phenomena has ever been adequately produced.

SUMMARY

With the present inventive subject matter, when a storm is approaching, a person simply raises the lift above the mounting blocks, slides the locking beams in place and then lowers the lift on top of the locking beams. Then the person pins the beams in place and straps down the boat.

A first exemplary embodiment including the inventive stabilizing system that is engageable with a watercraft lift assembly generally includes a piling bracket; at least one piling bracket keyhole in the piling bracket; a lift-block having at least one keyhole pin extending from a first side of the lift-block toward the at least one piling bracket keyhole; and a stabilizing beam, for supporting a watercraft lift assembly cradle, the stabilizing beam being attached to a second side of the lift-block.

Variations of this stabilizing stabilizing system that is engageable with a watercraft lift assembly can be configured such that the lift-block includes a lock-knob receiving recess (or through-hole) and the piling bracket includes a piling bracket lock-knob receiving recess (or through-hole) for receiving a threaded lock-knob. Further variations of this embodiment will be configured such that the watercraft lift assembly cradle is supported by the stabilizing beam.

Additionally, the stabilizing system engageable with a watercraft lift assembly can further include a threaded lock-knob engageable with the lock-knob receiving recess to secure the stabilizing beam to the piling bracket. Additional variations of this embodiment of the stabilizing system will be configured such that the threaded lock-knob will be a security lock. For example, the threaded lock-knob can be a lock itself such that when it is inserted in to the lock-knob receiving recess, it is irremovable without a key or combination. The threaded lock-knob can include a key receptacle for inserting a key into the lock or some portion of the lock-knob receiving recess can include a key receptacle for inserting a key into the lock. Or, the threaded lock-knob can include a key pad for entry of a security code; and, alternatively, some portion of the lock-knob receiving recess can include a key pad for entry of a security code.

A second exemplary embodiment disclosed herein is directed toward a watercraft lift including a plurality of pilings; a stabilizing system attached to at least one of the plurality of pilings; at least one pulley system supported by the plurality of pilings and attached to an upper side of the plurality of pilings; and a watercraft cradle supported by the pulley system and attachable to the stabilizing system.

Variations of this embodiment can be configured such that the stabilizing system includes a bracket fixedly attached to at least one of the plurality of pilings and a stabilizing beam attachable to the bracket and fixedly attached to the watercraft cradle. The stabilizing system can also include a plurality of brackets wherein each of the plurality of brackets is fixedly attached to a respective piling.

The cradle in this embodiment of a watercraft lift can include a boat rest slip supported by at least one transverse beam. This embodiment of the stabilizing system can also be comprised of a stabilizing beam attachable to a bracket and fixedly attached to the transverse beam. The watercraft cradle can be fixedly attached to the stabilizing system by a threaded fastener.

Additionally, this exemplary embodiment of the stabilizing system can further include a threaded lock-knob engageable with the lock-knob receiving recess to secure the stabilizing beam to the piling bracket. Additional variations of this embodiment of the stabilizing system will be configured such that the threaded lock-knob will be a security lock. For example, the threaded lock-knob can be a lock itself such that when it is inserted in to the lock-knob receiving recess, it is irremovable without a key or combination. The threaded lock-knob can include a key receptacle for inserting a key into the lock or some portion of the lock-knob receiving recess can include a key receptacle for inserting a key into the lock. Or, the threaded lock-knob can include a key pad for entry of a security code; and, alternatively, some portion of the lock-knob receiving recess can include a key pad for entry of a security code.

A third exemplary embodiment is a security system for locking a watercraft boatlift. The security system generally includes at least one bracket that is fixedly attached to a piling and a lateral beam having at least one keyhole pin. The bracket has a keyhole that is engageable with the keyhole pin. When not engaged, the keyhole pin extends toward the keyhole. A security device engageable with the keyhole pin, and having a security key, can be placed on a head portion of the keyhole pin. The security device can be a lock (padlock, combination lock, keycode, etc.) that engages with an anchor mechanism such as a hook or arc that is welded to the watercraft lift.

DETAILED DESCRIPTION

The word "exemplary" is used herein to mean serving as an example, instance, or illustration. Any embodiment described herein as "exemplary" is not necessarily to be construed as preferred or advantageous over other embodiments.

Figure 1:
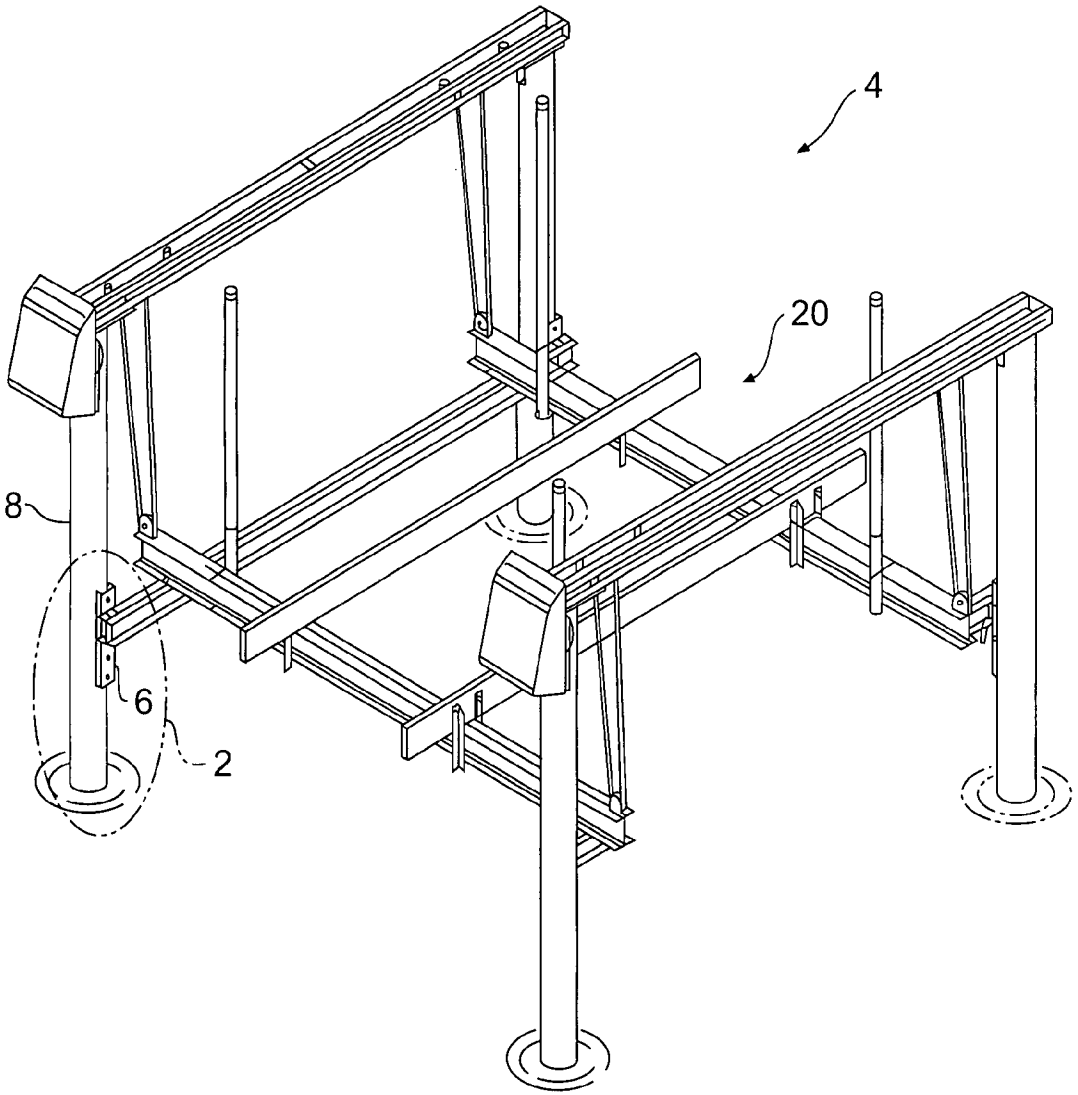
FIG. 1 shows a perspective view of an embodiment of a watercraft lift assembly.
Figure 2A:
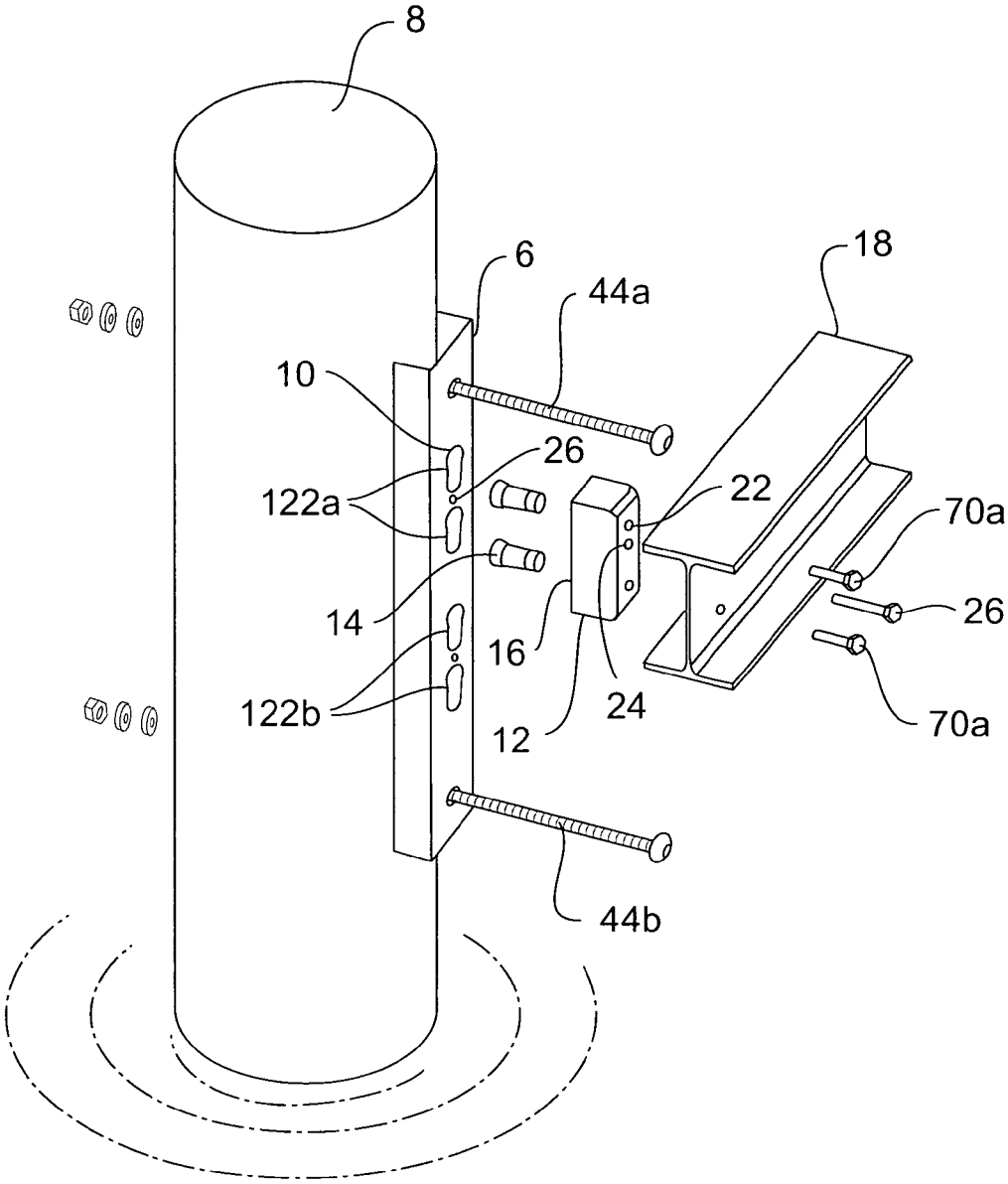
FIG. 2*a* shows an exploded view of an embodiment of a stabilizing system.

FIG. 1 shows a perspective view of an exemplary embodiment of the inventive stabilizing system 2 attached to a watercraft lift assembly 4. With reference to FIG. 2*a*, in this exemplary embodiment, the stabilizing system 2 includes a piling bracket 6 that is attachable to a watercraft lift assembly piling 8 using a first carriage bolt 44*a* and a second carriage bolt 44*b*, at least one piling bracket keyhole 10 in the piling bracket 6, a lift-block 12 having at least one keyhole pin 14 extending from a first side 16 of the lift-block 12 toward the at least one piling bracket keyhole 10; and a stabilizing beam 18, for supporting a watercraft lift assembly cradle 20. The stabilizing beam 18 is attached to a first side 22 of the lift-block 12. This exemplary embodiment of the stabilizing system 2 that is engageable with a watercraft lift assembly 4 can be configured such that the lift-block 12 includes a lock-knob through-hole 24 (shown in FIG. 3).

A threaded lock-knob 26 helps to secure the stabilizing beam 18 to the piling bracket 6. The threaded lock-knob 26 has a lock-knob head configured with lock-knob head flanges positioned around the circumference of the lock-knob head. Each lock-knob head flange is positioned ninety degrees away from the next lock-knob head flange. The lock-knob head contains a removable screw. The removable screw can be screwed into a lock-knob opening in the lock-knob head. To insure that the removable screw is secured to the lock-knob head, the removable screw can be manufactured such that it is slightly larger in diameter than the lock-knob head opening. Alternatively, the removable screw can be permanently attached to the lock-knob head opening through an adhesive.

Figure 2B:
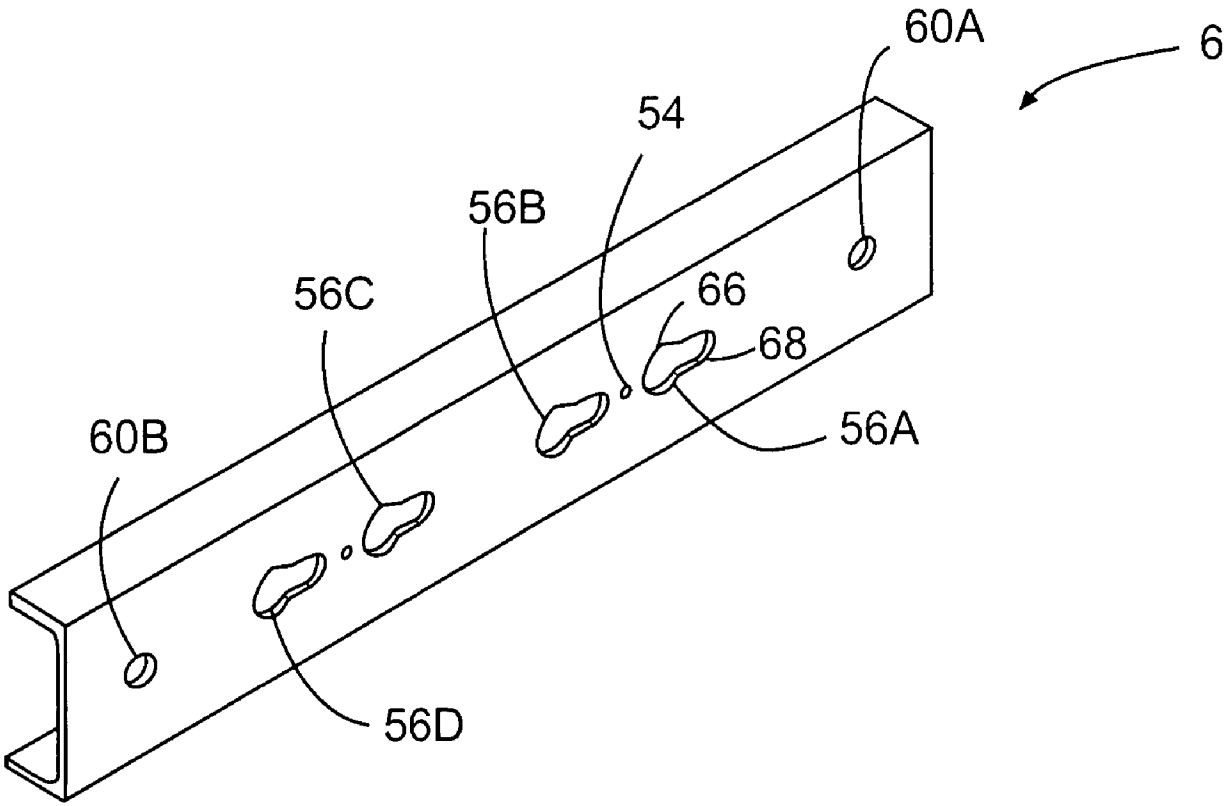
FIG. 2*b* shows a perspective view of a piling bracket usable in an embodiment of the present inventive subject matter.

With reference to FIGS. 1 and 2*b*, the piling bracket 6 includes a piling bracket lock-knob receiving recess 54 for receiving a threaded lock-knob 26. The piling bracket 6 further includes pin keyholes 56*a*, 56*b*, 56*c* and 56*d*. The pin keyholes 56*a*-56*d* receive keyhole pins 14 (shown in FIGS. 2*c*-2*d*). Additionally, the piling bracket 6 includes carriage bolt through-holes 60*a* and 60*b* for receiving carriage bolts 44*a* and 44*b*. Carriage bolts 44*a* and 44*b* pass through a respective carriage bolt through-hole 60*a* or 60*b* and through the watercraft lift assembly piling to secure the piling bracket 6 to a watercraft lift assembly piling 8.

Figure 2D:
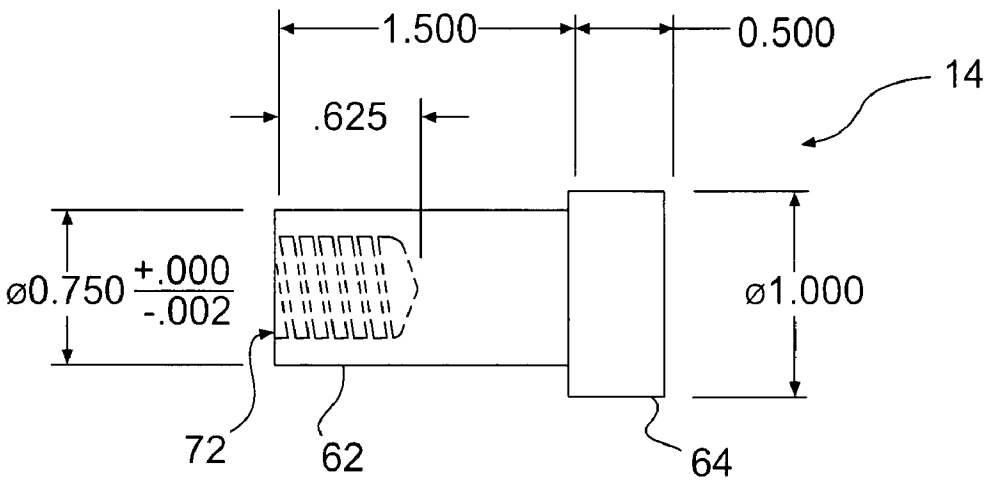
FIG. 2*d* shows a cross-sectional view of a keyhole pin with a receiving recess.
Figure 2C:
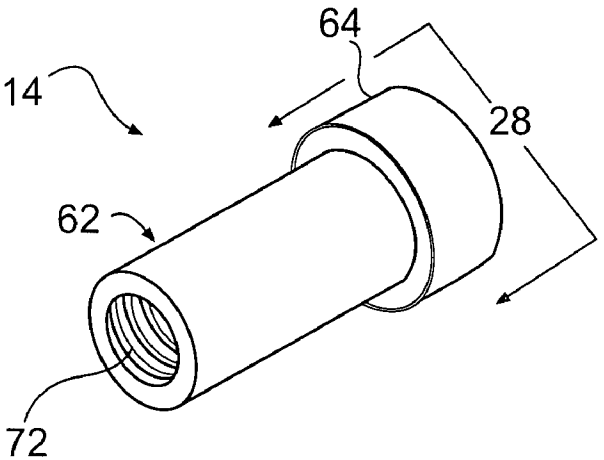
FIG. 2*c* shows a perspective view of a keyhole pin.

A keyhole pin 14 is shown in FIGS. 2*c* and 2*d*. The keyhole pin 14 includes a keyhole pin neck 62 and a keyhole pin engaging portion 64. In operation, the keyhole pin engaging portion 64 slides into large end 66 of any of the pin keyholes 56*a*-56*d*. To lock the keyhole pin 14 in place, the keyhole pin 14 slides toward the end 68 of the pin keyhole that is opposite that of the large end 66. The keyhole pin neck 62 should be thin enough to slide through small end 68 of the pin keyhole portion. The engaging portion 64 is too large to slide out of through small end 68 along the axis of the keyhole pin; therefore, the keyhole pin 14 cannot be removed unintentionally.

Figure 3:
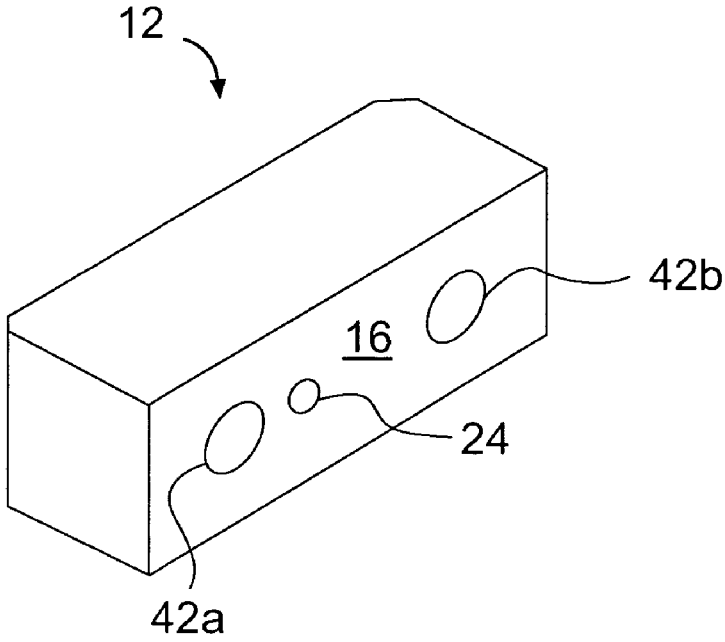
FIG. 3 shows a perspective view of a lift-block.

Particular detail of a first side 16 of the lift block 12 is shown in FIG. 3. With reference to FIGS. 1 and 3, the lift-block 12 remains secured to the stabilizing beam and the keyhole pins remain secured to the lift-block through the use of two hex-bolts 70*a* and 70*b*. The hex-bolts 70*a* and 70*b* pass through a respective through-hole in the stabilizing beam and pass through a respective lift-block through-hole 42*a* and 42*b* in the lift-block. Finally, the hex-bolts 70*a* and 70*b* matingly engage a hex-bolt receptacle 72 (shown in FIG. 2*c*) in a respective keyhole pin 14. The receiving recess 24 is generally positioned between a first lift-block through-hole 42*a* and a second lift-block through-hole 42*b*.

Figure 4:
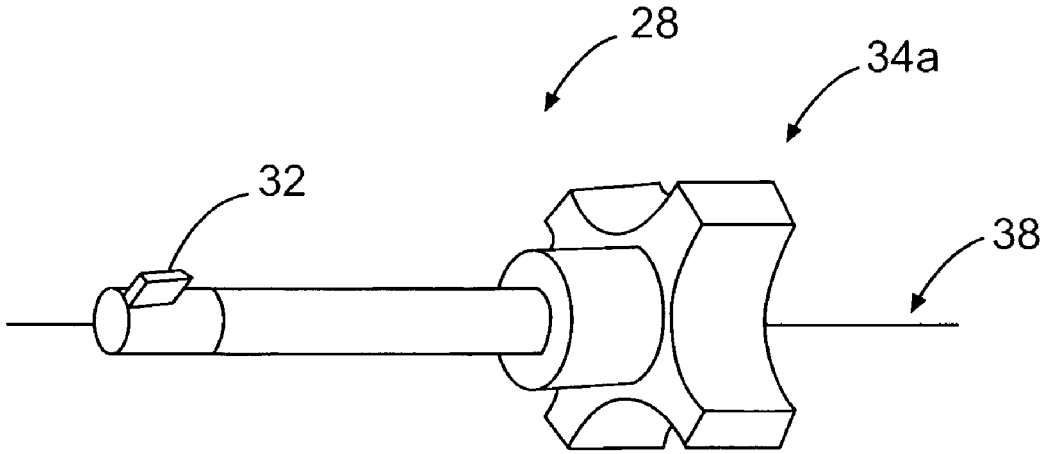
FIG. 4 shows a perspective view of a security lock-knob.
Figure 5:
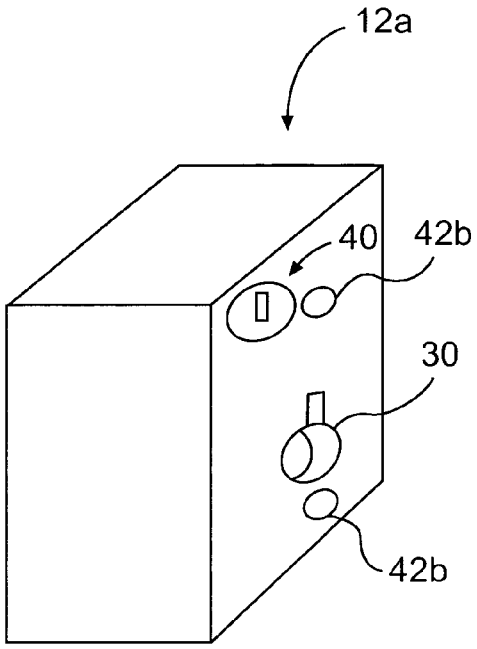
FIG. 5 shows a perspective view of a security lift-block.

Additional variations of this exemplary embodiment of the stabilizing system 2 are configured such that the threaded lock-knob 26 is a security lock. For example, as shown in FIG. 4, a lock-knob restraining bolt 28 can be used as a security device in place of or in addition to lock-knob 26. Either the piling bracket 6 or the lift-block 12 can include a lock-knob restraining bolt keyhole 30. As shown in FIG. 5, the lift-block 12*a* is configured to include a keyhole 30 for the lock-knob restraining bolt 28 and can have a restraining flange 32 at a distal end thereof to prevent removal of the lock-knob restraining bolt 28 from the lift-block 12*a*. The type of restraining mechanism associated with the lock-knob restraining bolt is not limited to a flange; rather a flange is only shown as an example of how the lock-knob restraining bolt can be used as a security device.

Figure 6A:
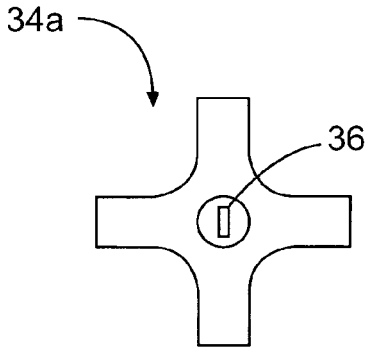
FIG. 6*a* shows a plan view of the head of the lock-knob of FIG. 5 having a security key receptacle.
Figure 6B:
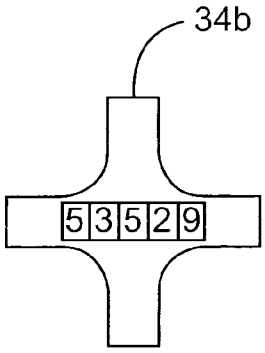
FIG. 6*b* shows a plan view of the head of the lock-knob of FIG. 5 having a security combination lock.
Figure 6C:
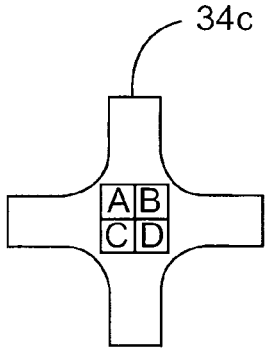
FIG. 6*c* shows a plan view of the head of the lock-knob of FIG. 5 having a security keypad.
Figure 6D:
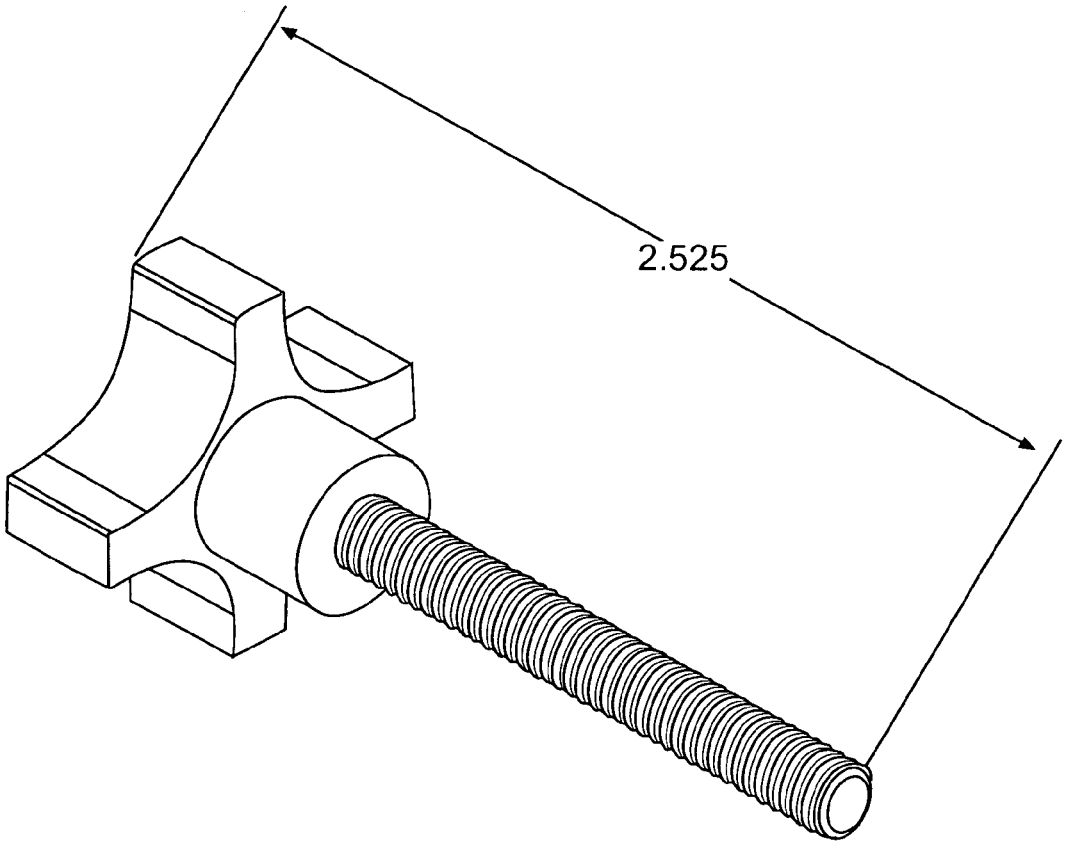
FIGS. 6*d*-6*j* show an alternative construction of the lock know that omits a security feature and rather includes a screw-like engagement feature.
Figure 6E:
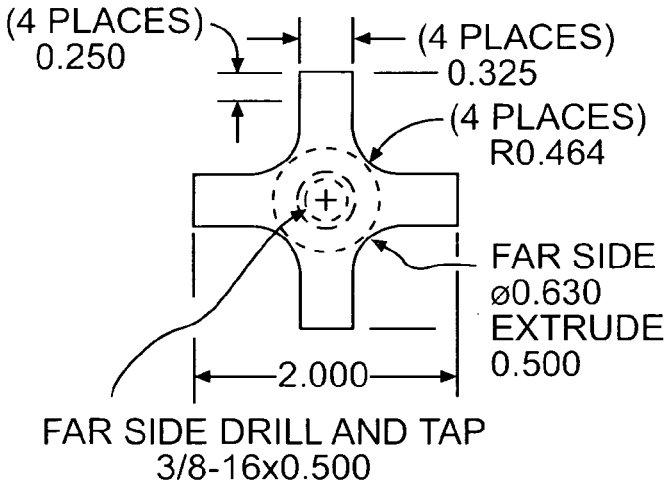
Figure 6F:
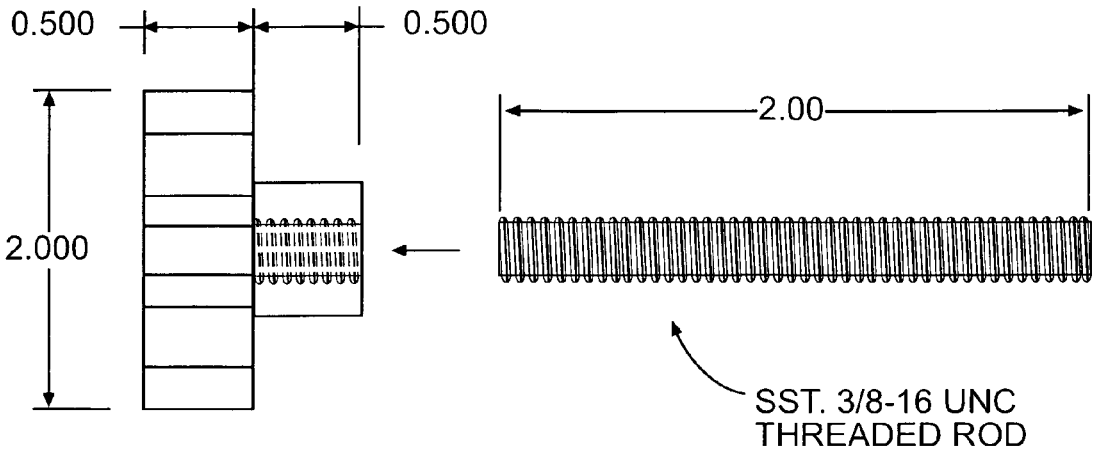
Figure 6G:
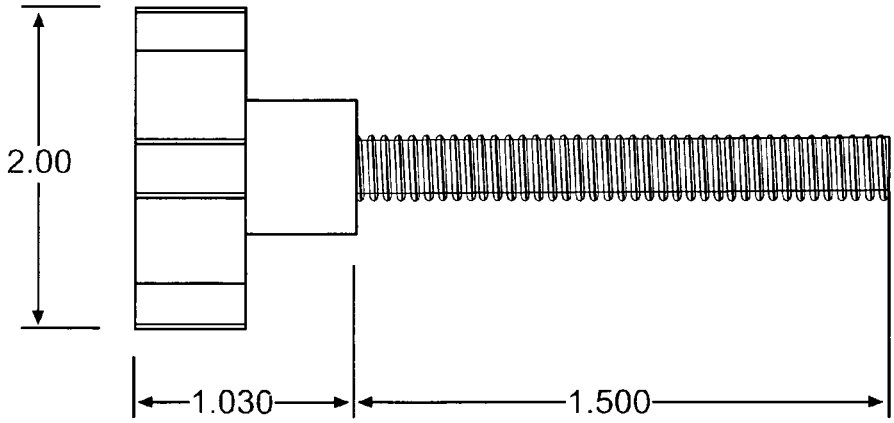
Figure 6I:
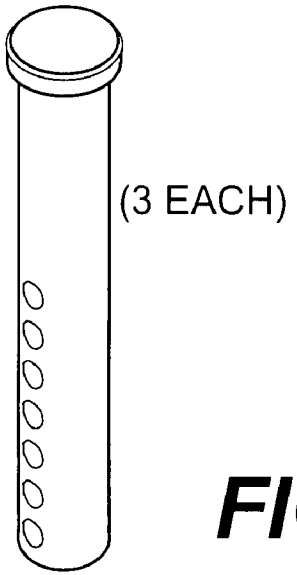
Figure 6J:
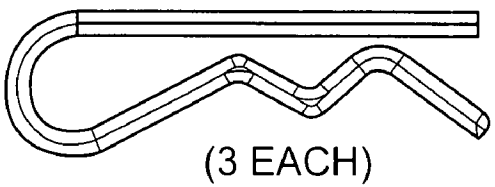
Figure 6H:
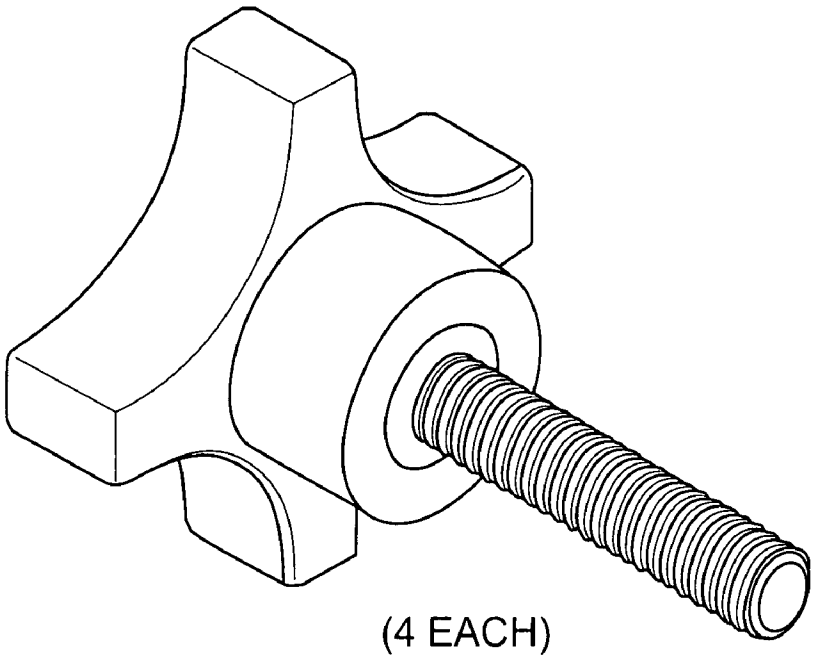

Additionally, as shown in FIG. 6*a*, the head 34*a* of the lock-knob restraining bolt 28 can include a security keyhole 36 for receiving a security key (not shown) that engages or disengages the locking feature of the lock-knob restraining bolt 28. The security feature of this exemplary embodiment operates by causing the restraining flange 32 to rotate about the lock-knob restraining bolt's axis of rotation 38 so that it engages with a restraining member (not shown) within the lift-block 12*a* or within the piling bracket 6. Thus, when the lock-knob restraining bolt 28 is inserted in to the lock-knob restraining bolt keyhole 30, it is irremovable without a key or combination. FIG. 6*b* shows a head 34*b* of the lock-knob restraining bolt 28 with a combination lock therein, while FIG. 6*c* shows a head 34*c* of the lock-knob restraining bolt 28 having an electronic keypad for entry of a combination. Alternatively, rather than place a keyhole or keypad on the head 34*a*, 34*b* or 34*c* of the lock-knob restraining bolt 28, a portion 40 of the lift-block 12*a* can include a keyhole or keypad for entry of a key or of a security code. If the lift-block 12*a* is positioned between the piling bracket 6 and the stabilizing beam 18, a relief can be cut in the stabilizing bean to provide access to the portion 40 of the lift-block that includes the keyhole or keypad. Also, as shown in FIGS. 6*d*-6*j*, an alternative construction of the lock knob omits a security feature and rather includes a screw-like engagement feature.

Further variations of this embodiment are configured such that the watercraft lift assembly cradle 20 is supported by the stabilizing beam 18. Alternatively, the cradle can be supported by a pulley system.

Figure 7A:
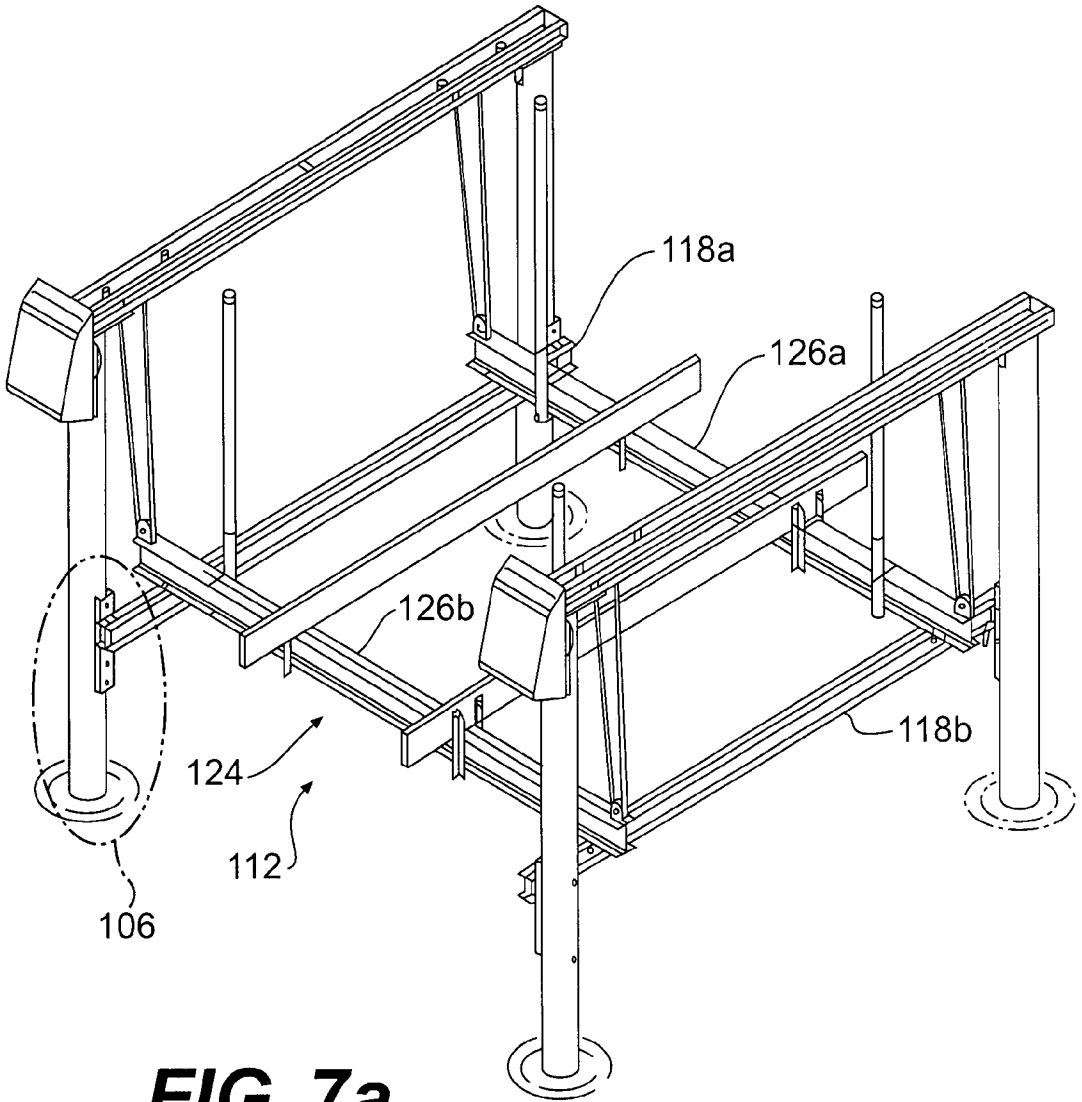
FIG. 7*a* shows a perspective view of a second embodiment the watercraft lift assembly.
Figure 7B:
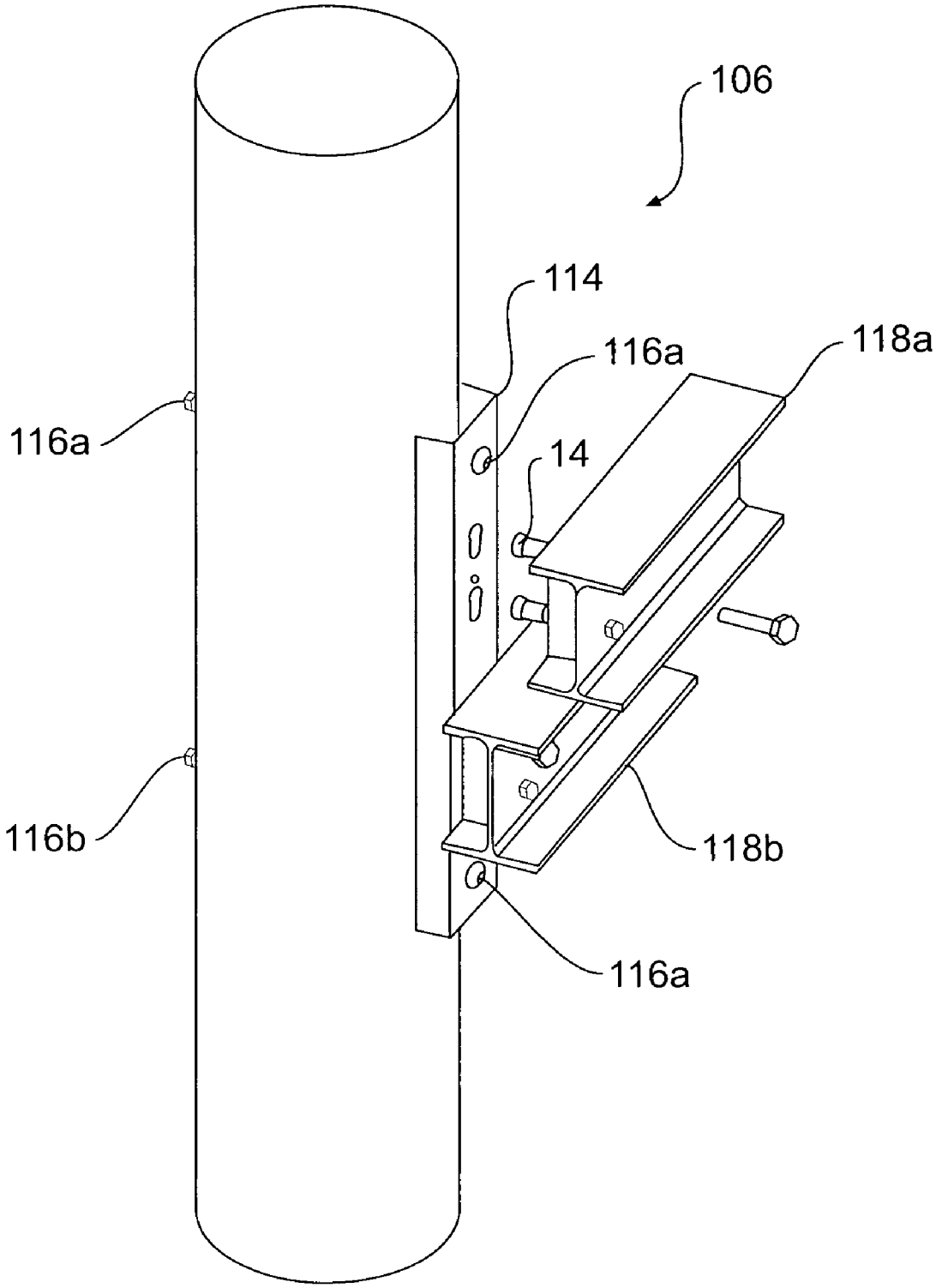
FIG. 7*b* shows a perspective view of a stabilizing system of the second embodiment of the watercraft lift assembly.
Figure 7C:
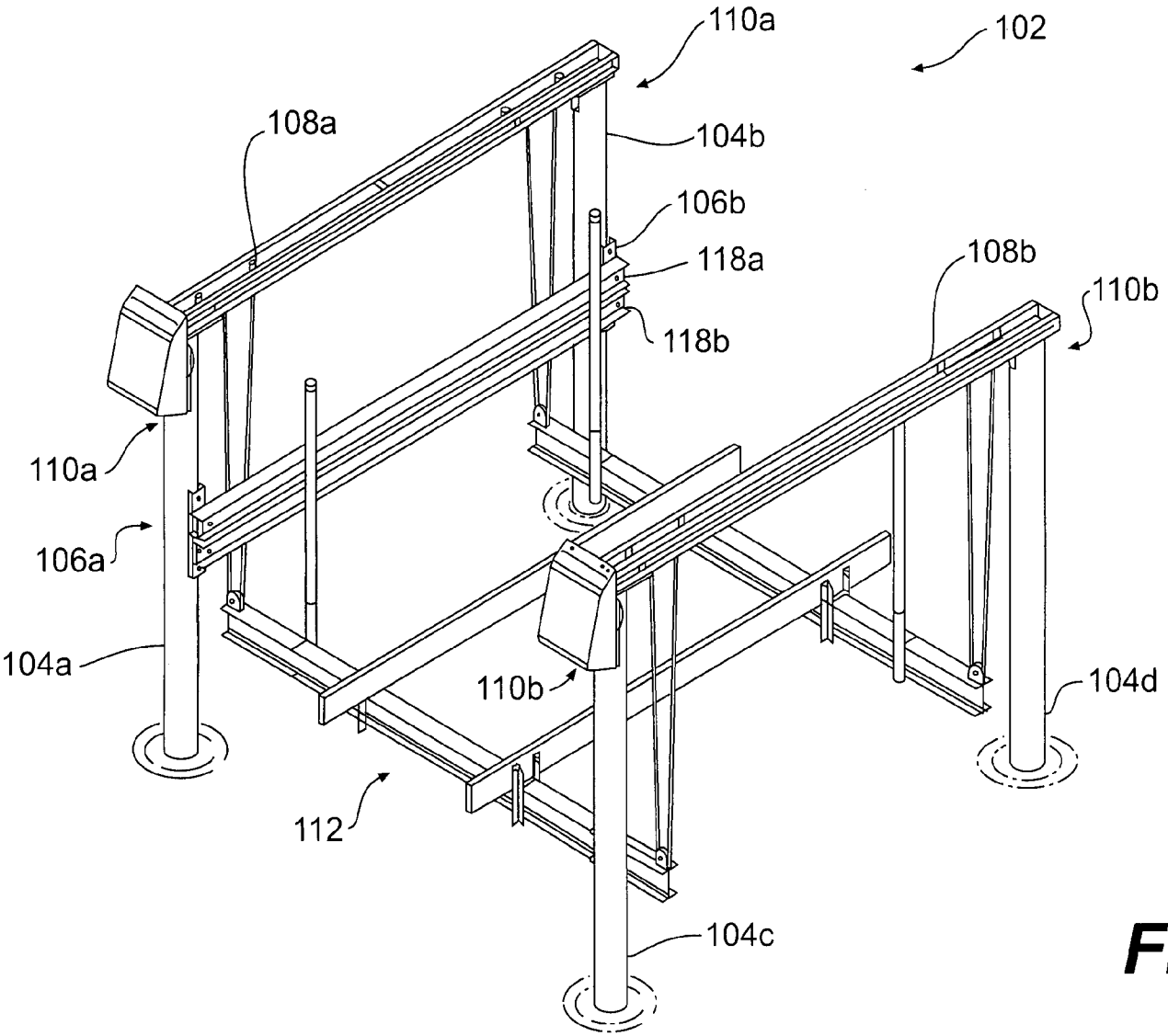
FIG. 7*c* shows a configuration of the water craft assembly when not in use.

A second exemplary embodiment disclosed herein is shown in FIG. 7*a*-7*c* as a watercraft lift assembly 102. The watercraft assembly 102 generally includes a plurality of pilings 104*a*, 104*b*, 104*c*, and 104*d*; at least one stabilizing system 106*a* and an optional additional stabilizing system 106*b* each attached to at least one of the plurality of pilings 104*a*, 104*b*, 104*c* or 104*d*; and at least one pulley system 108*a* or 108*b*. Each pulley system is supported by two of the plurality of pilings 104*a* and 104*b* or 104*c* and 104*d* and attached to an upper side 110*a* or 110*b* of the plurality of pilings 104*a*, 104*b*, 104*c* or 104*d*. A watercraft cradle 112 is supported by the pulley system 108*a* or 108*b* and attachable to the stabilizing system 106*a* or 106*b*.

For ease of discussion, the plurality of pilings 104*a*-104*d* will be referred to generally as 104; and the plurality of stabilizing systems 106*a* and 106*b* will generally be referred to as 106. Furthermore, a person having ordinary skill in the art will understand that each of the plurality of pilings 104 can include its own stabilizing system.

With reference to FIG. 7*a*-7*b* showing the watercraft lift assembly in use, the stabilizing system 106 includes a bracket 114 secured to a piling 104 by two carriage bolts 116*a* and 116*b* that pass through the piling 104. At least one stabilizing beam 118*a* is attachable to both the bracket 114 and to the watercraft cradle 112. To enhance stability of the stabilizing system 106, a second beam 118*b* is added to a side of the watercraft lift assembly that is opposite that of the one stabilizing beam 118*a*. When in use (that is, when a watercraft is stored in the watercraft lift assembly cradle 112), the watercraft lift assembly cradle 112 rests on and is attached to both of the stabilizing beams 118*a* and 118*b*. The stabilizing beams 118*a* and 118*b* can be is attached to the watercraft lift assembly cradle 112 by cradle bolts 120.

FIG. 7*c* shows a configuration of the water craft assembly when not in use, i.e., when no watercraft is support by the watercraft lift assembly cradle. In this embodiment, the stabilizing beam 118*b* can be removed from the "in use" side of the watercraft lift assembly and stored on the same side of the watercraft lift assembly as stabilizing beam 118*a*. This type of storage is possible due to the inclusion of two sets 122*a* and 122*b* of pin keyholes 122*a* and 122*b*.

The watercraft lift assembly cradle 112 in this exemplary embodiment of the present subject matter includes a boat rest slip 124 supported by at least one transverse beam 126*a*. Additionally, a second transverse beam 126*b* is added to the watercraft lift assembly cradle 112 for added support.

Additionally, this exemplary embodiment of the stabilizing system 106 further includes a threaded lock-knob 26 like that in previous embodiments. The threaded lock-knob 26 is engageable with the lock-knob receiving recess 24 to secure the stabilizing beam 18 to the piling bracket 6. Also similar to the previous embodiments, the threaded lock-knob 26 can be a security lock. For example, the threaded lock-knob 26 can be a lock itself such that when it is inserted in to the lock-knob receiving recess 24, it is irremovable without a key or combination. The threaded-lock-knob 26 can include a key receptacle for inserting a key into the lock or some portion of the lift-block 12. Or, the threaded lock-knob 26 can include a key pad for entry of a security code. Alternatively, some portion of the lift-block can include a key pad for entry of a security code.

Figure 8:
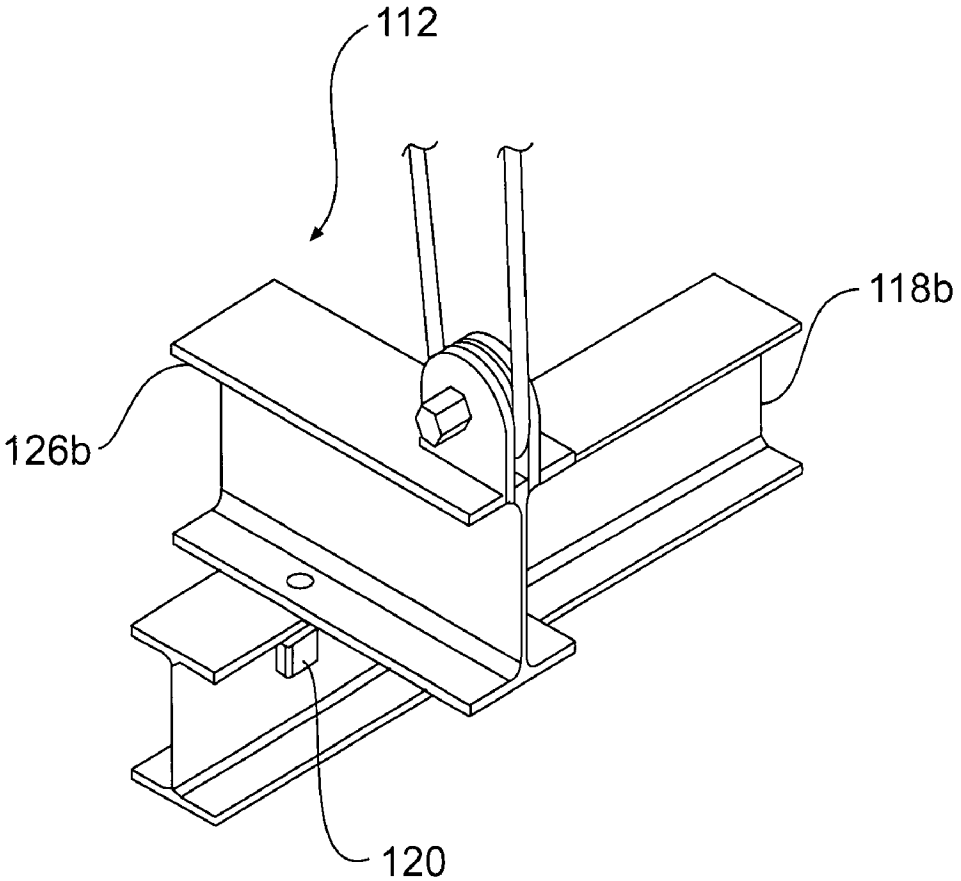
FIG. 8 shows an intersection between the watercraft lift assembly cradle and a transverse beam.
Figure 9A:
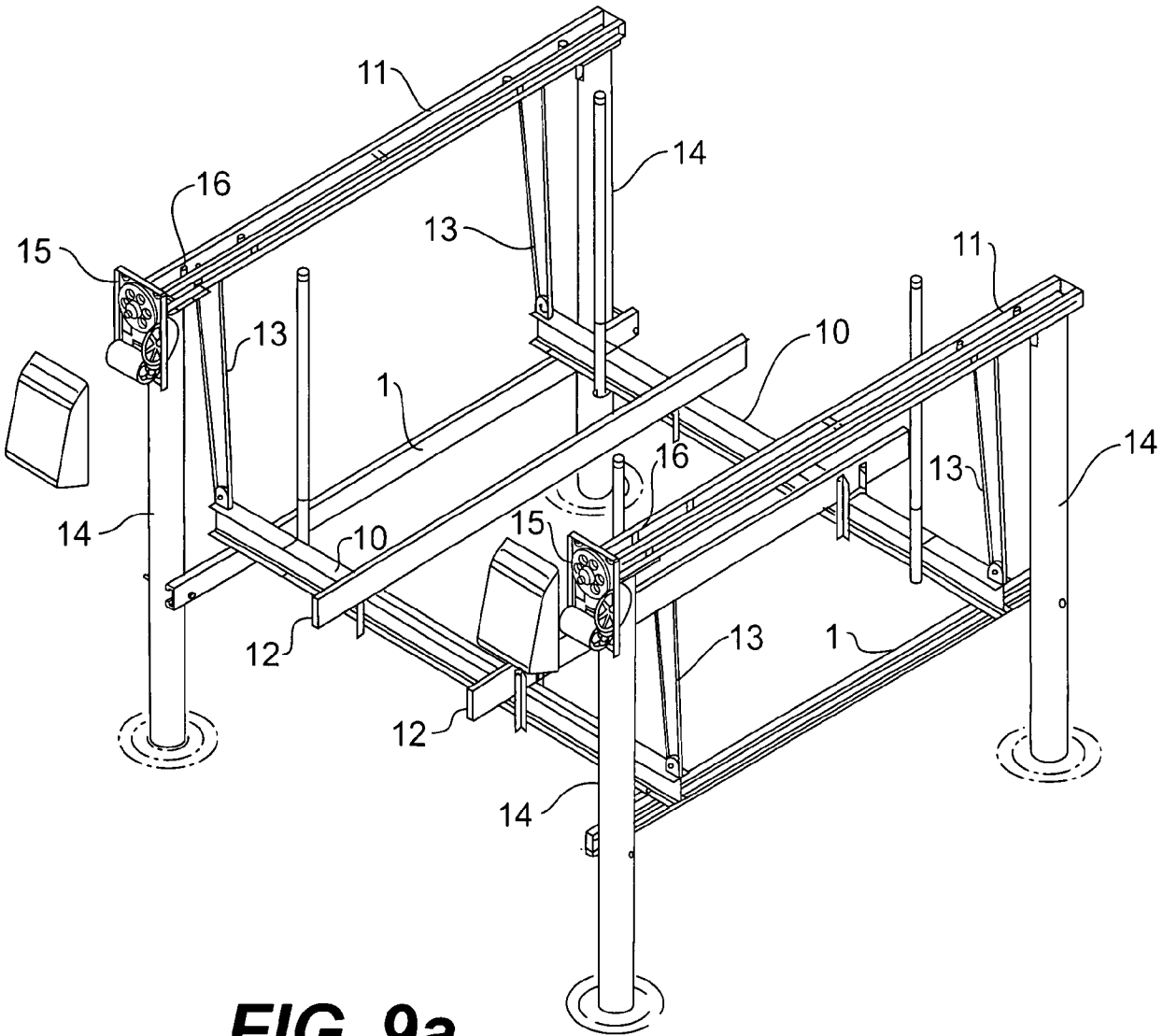
FIGS. 9*a*-9*i* show a yet further embodiment of the inventive subject matter.
Figure 9B:
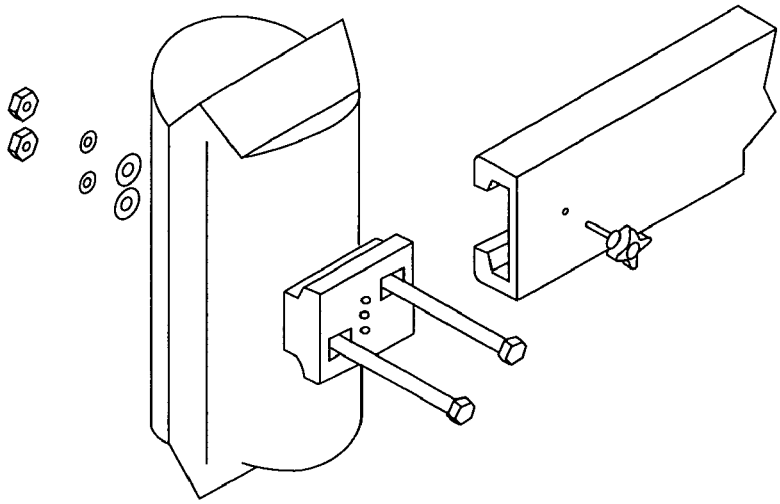
Figure 9C:
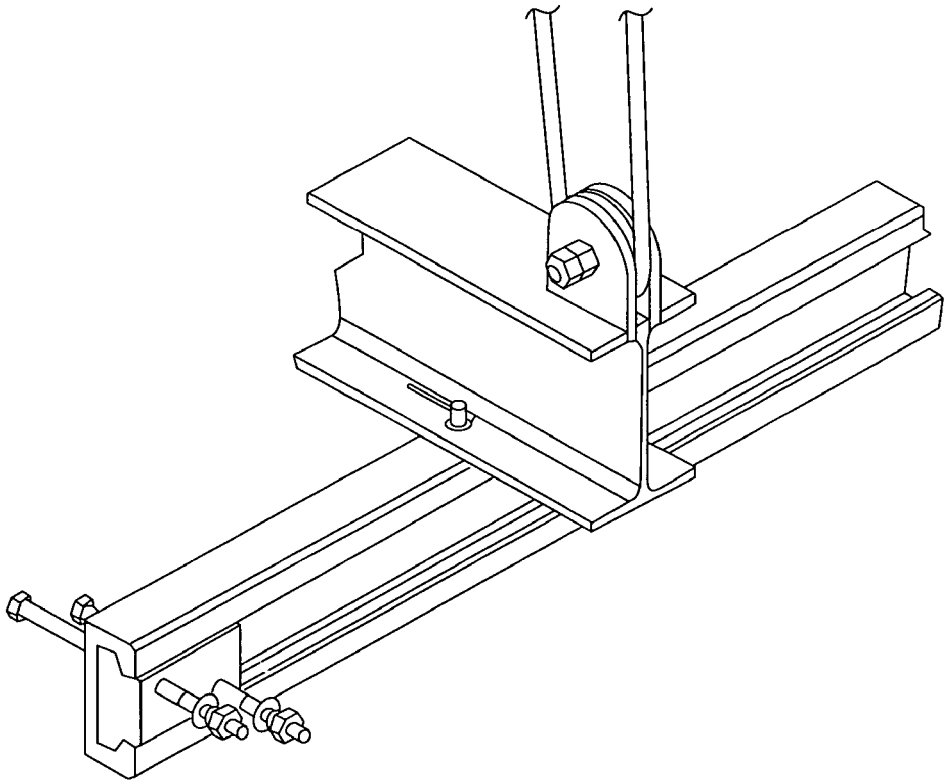
Figure 9D:
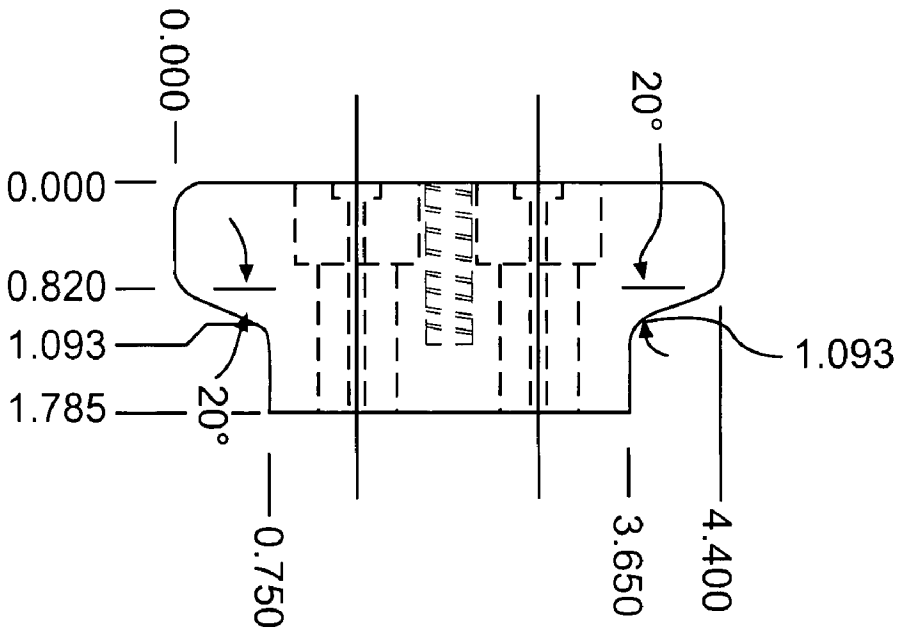
Figure 9E:
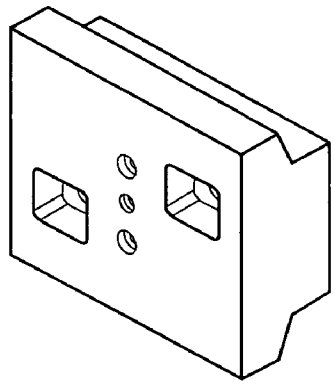
Figure 9F:
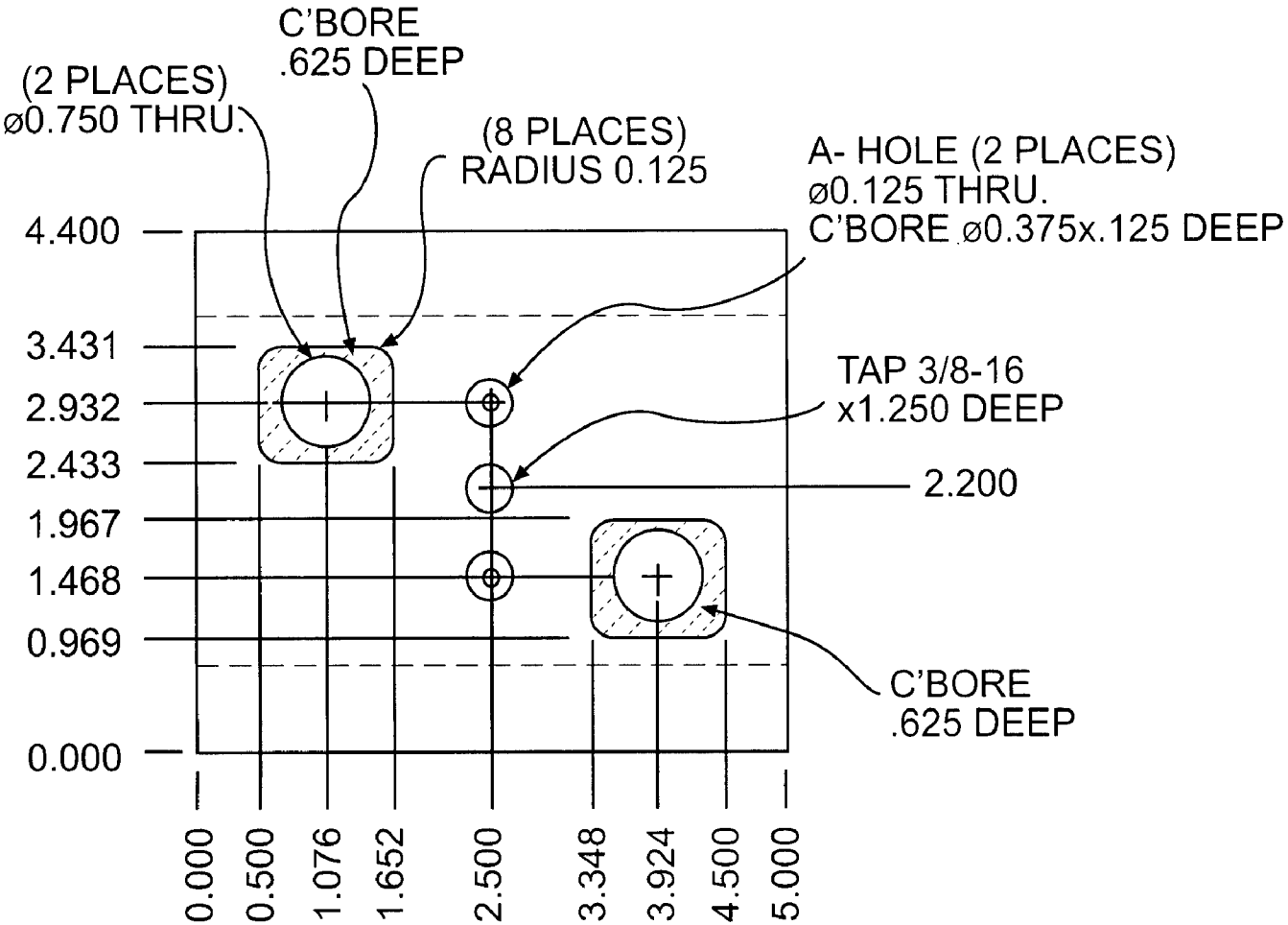
Figure 9H:
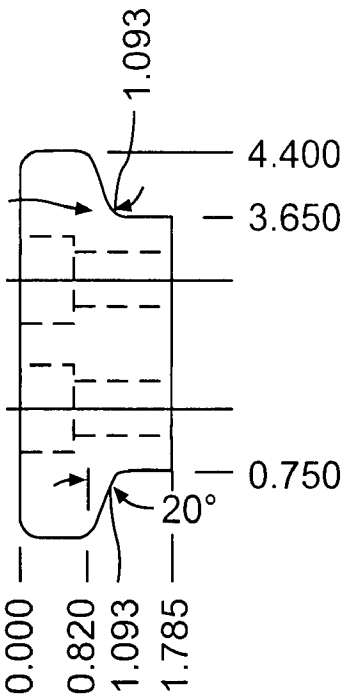
Figure 9G:
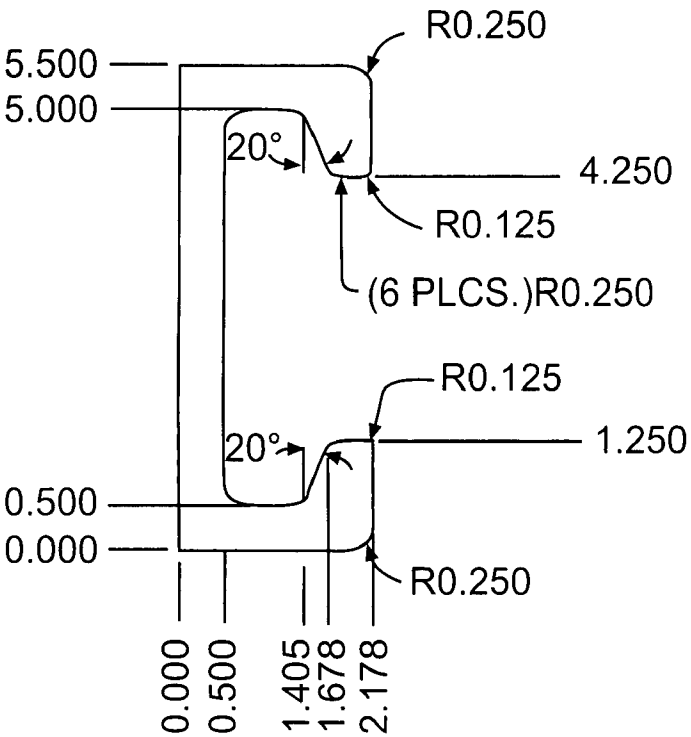
Figure 9I:
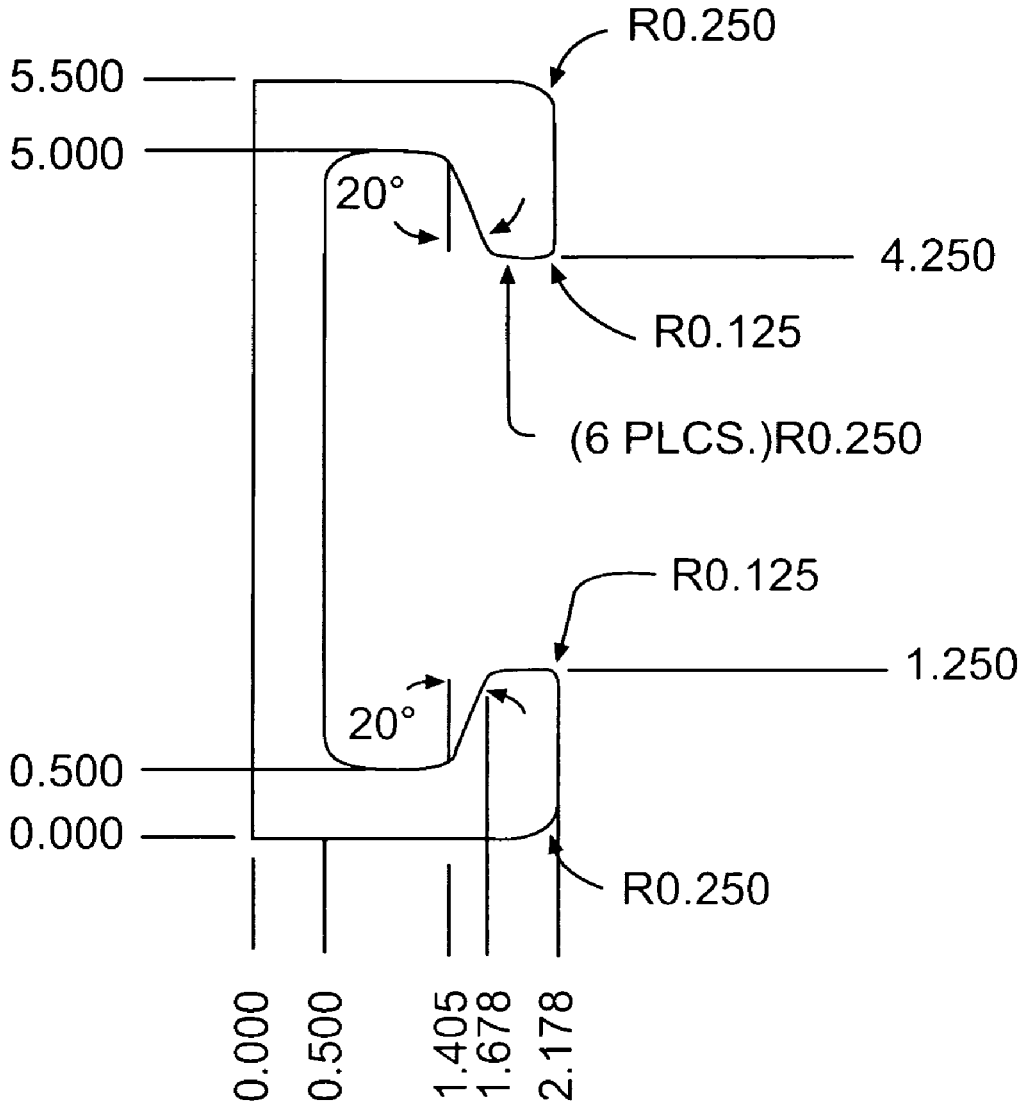

As an alternative to the security measures provided herein, the security system can be configured such that a security keyhole, combination lock or security keypad is positioned to maintain the transverse beam 126*a* or 126*b* in fixed communication with the stabilizing beam 118*a* or 118*b*. With reference to FIG. 8, the stabilizing beam 118*b* is held in fixed position relative to the transverse beam 126*b* with a cradle bolt 120. The security accessories of the cradle bolt 120 can be configured similarly to the lock-knob restraining bolt 28 described above in that it can in include a security keyhole, combination lock, or security keypad. In a more rudimentary fashion, the cradle bolt (as well as any of the other security devices described in this document) can be a lock (padlock, combination lock, keycode, etc.) that engages with an anchor mechanism such as a hook or arc that is welded to either the stabilizing beam 118*b* or the transverse beam 126*b*. Or, a lock can be used at every intersection of the stabilizing beams 118*a* and 118*b* with the transverse beams 126*a* and 126*b*.

An embodiment of the stabilizing system is shown in FIGS. 9*a*-9*i*. This embodiment includes a stabilizing beam (1) that is slidable onto a liftblock (2) on upright column. The liftblock has a mushroom shaped cross section. The stabilizing beam (1) has a c-shaped cross-section such that the stabilizing beam is slidable over a head portion of the liftblock (2). Two liftblocks per side, a forward and a rearward liftblock, should be used. A second set of lift blocks are placed on a side of the lift opposite that of the first set to provide an attachment means for a second stabilizing beam.

A cradle is fixedly attached to the stabilizing beam through screws, bolts, or locks. To remove the stabilizing beam (1) from the liftblock (2), unfixes the cradle from the stabilizing beam and then raises the cradle to provide easier access to the stabilizing beam (2). The person then manually removes the stabilizing beam (1) by sliding it off of the liftblock (2). The cradle can then be lowered into the water thereby allowing a boat to enter or exit the cradle.

A stabilizing beam can be attached to each side of the boat lift. The stabilizing beam should be on the side of the lift that is common with a dock so that it is accessible to a person that wants to remove the beam. The second stabilizing beam should be on the side of the lift that is opposite that of the first stabilizing beam to provide enhanced stability. A walk-board, plank or any other kind of surface that can support a person can be added to an outer side of the lift to provide a person with the ability to access the second stabilizing beam. When not in use, i.e., when a boat is not docked in the lift, the stabilizing beams are simply slid over its respective liftblock.

The liftblock is attached to an upright post or piling using at least two bolts. One bolt can be used; however, to reduce the tendency to rotate about the axis of the bolt, a second bolt should be added. When used to secure the liftblock to a piling, the head of each bolt should be within the surface of the liftblock to avoid becoming an obstruction to the beam.

The base of the liftblock is planar so that when the liftblock is attached to a piling that is made of wood or some other soft material, the liftblock can dig into a piling. Alternatively, the base of the liftblock can be formed to fit the shape of the surface of the piling. As such, the lift block can be manufactured so that it fits with a piling made of a harder material such as concrete that resists the tendency to deform under pressure.

As mentioned above, the stabilizing beam has a c-shaped cross-section so that it can matingly connect with the liftblock. The stabilizing beam also includes a channel (7) in an upper edge thereof to receive a pin or other securing device to affix the stabilizing beam to a cradle. The securing device can be a cotter pin, a security device, a bolt, a pin, or any other item that can fit through the channel (7). The cradle itself can have a pin welded to a bottom surface thereof, or the cradle can have a channel that corresponds to the channel of the stabilizing beam through which a pin will be inserted.

Figure 10A:
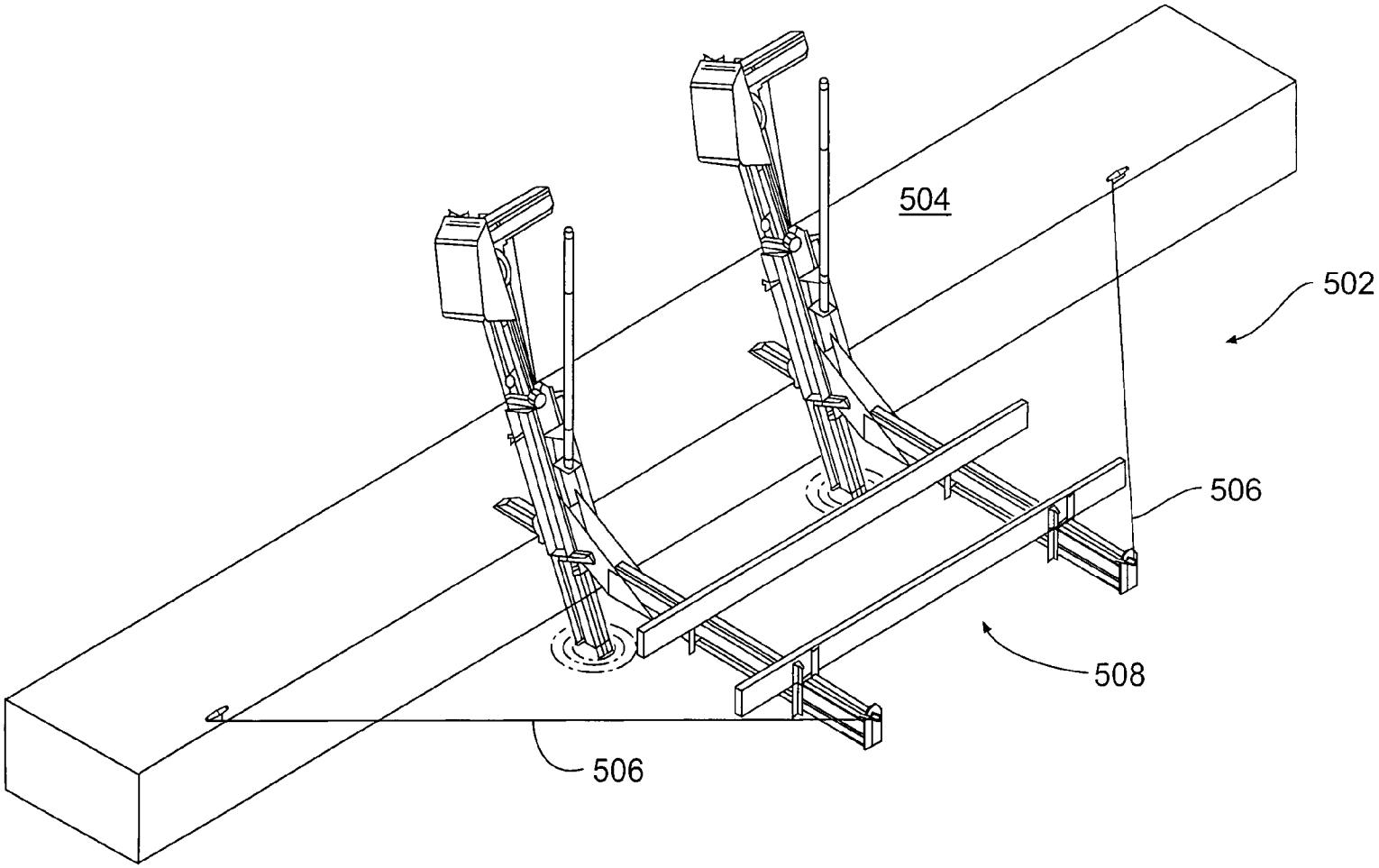
FIGS. 10*a*-10*d* show an additional embodiment of the inventive subject matter having a triple I-beam construction and wherein a lower cradle is attached to a dock and rises from under a liftlock beam.
Figure 10B:
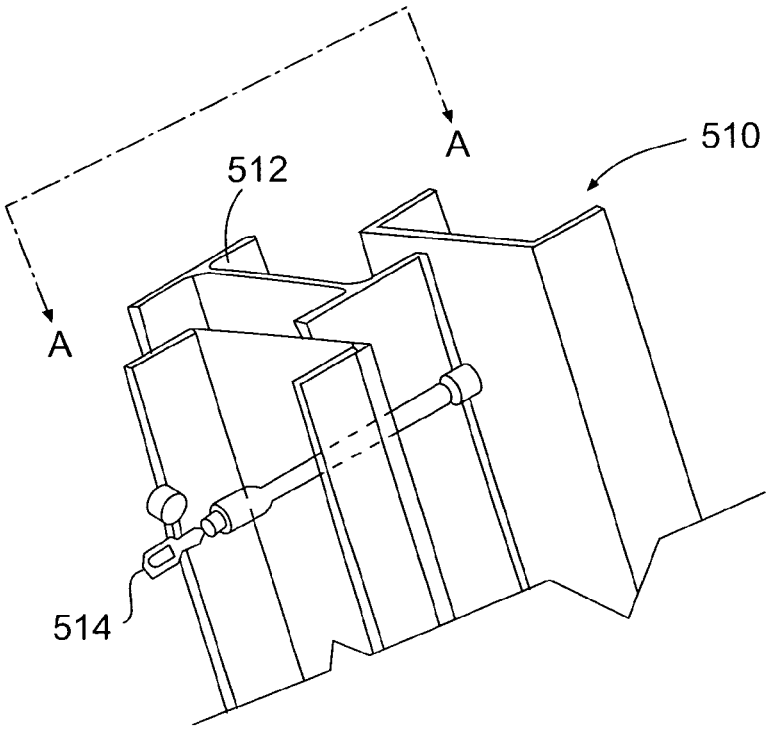
Figure 10C:
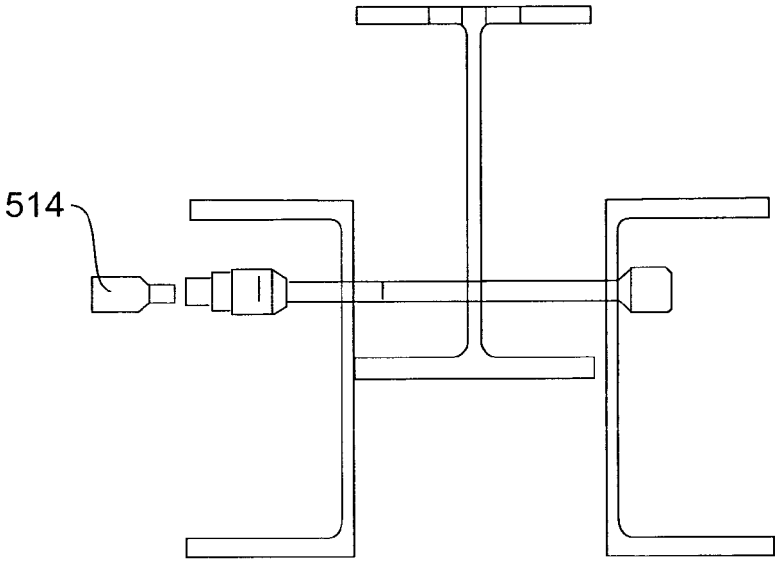

As shown in FIG. 10*a*, an additional embodiment 502 of the present inventive subject matter is made to directly engage dock 504. Lines 506 are attached to dock 504 to provide additional support for cradle 508. This embodiment of the inventive system can be motorized or manual and can be configured such that the cradle 508 also extends horizontally in a direction away from the dock 504 for easier launching and capturing of a watercraft. The lock feature in this system is configured as a triple I-beam unit 510 wherein one beam, beam 512 for example, is configured to raise and lower with the cradle 508. To lock the cradle in place, during a storm or other inclement weather for example, locking device 514 slides through holes (not shown) in each beam that line up when all of the beams are at a preset height.

Figure 10D:
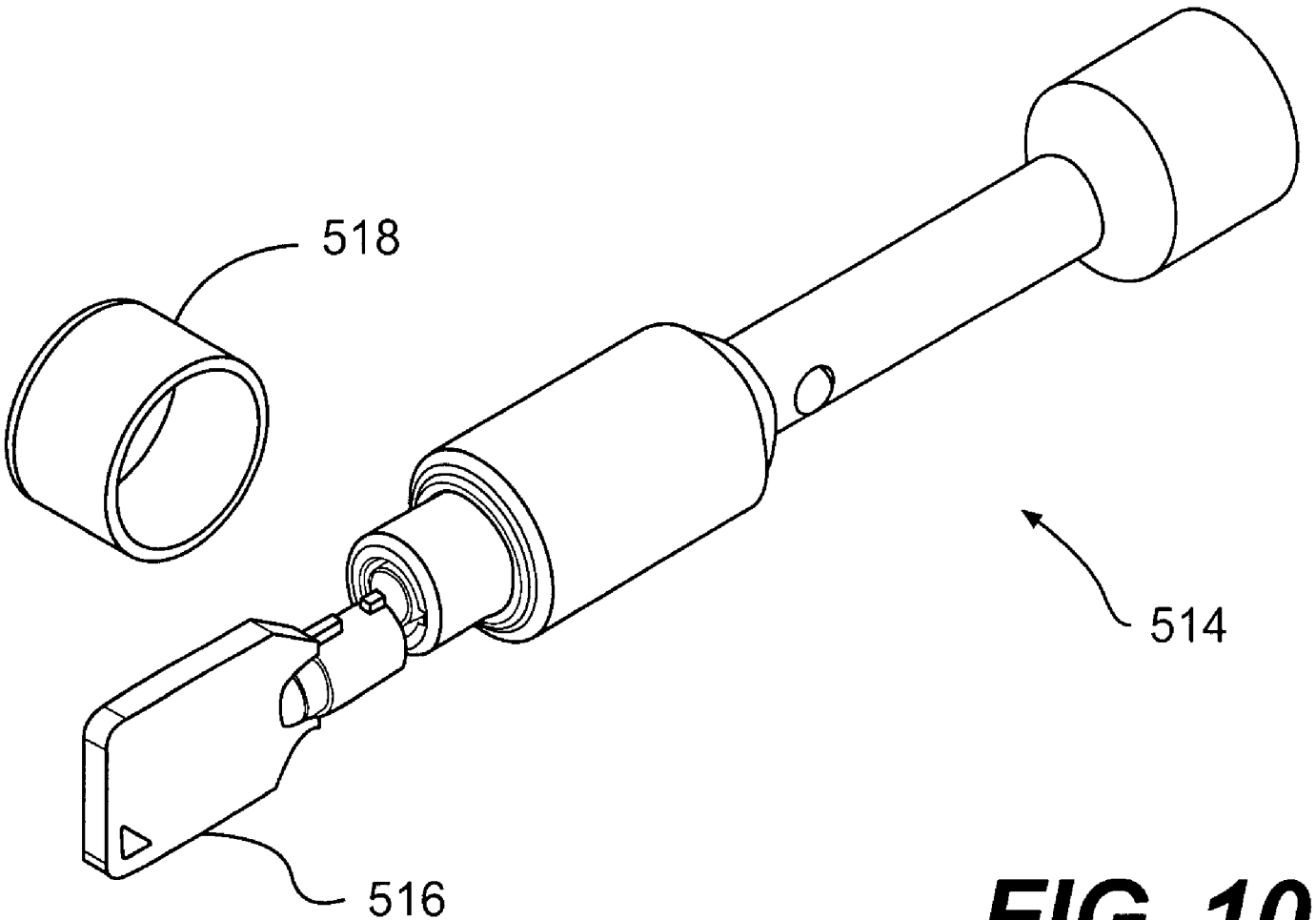

Locking device 514 is shown with greater particularity in FIG. 10*d*. In this embodiment, locking device 514 is equipped with a security lock wherein a key 516 is used to engage and disengage the security lock. Also, to protect the lock from rusting during rainy weather, a cap is added to shield key access to the locking device 514.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. For example, one or more elements can be rearranged and/or combined, or additional elements may be added. Thus, the present invention is not intended to be limited to the embodiments shown herein but is to be accorded the widest scope consistent with the principles and novel features disclosed herein.

I claim:

1. A stabilizing system engageable with a watercraft lift assembly comprising:

a piling bracket;

at least one piling bracket keyhole in said piling bracket;

a lift-block having at least one keyhole pin extending from a first side of said lift-block toward said at least one piling bracket keyhole; and a stabilizing beam, for supporting a watercraft lift assembly cradle, said stabilizing beam being attached to a second side of said lift-block.

2. A stabilizing system engageable with a watercraft lift assembly as recited in claim 1 wherein said at least one lift-block is further comprised of a lock-knob receiving recess.

3. A stabilizing system engageable with a watercraft lift assembly as recited in claim 2 wherein said piling bracket comprises a piling bracket lock-knob receiving recess for receiving said threaded lock-knob.

4. A stabilizing system engageable with a watercraft lift assembly as recited in claim 3 further comprising a threaded lock-knob engageable with said lock-knob receiving recess to secure said stabilizing beam to said piling bracket.

5. A stabilizing system engageable with a watercraft lift assembly as recited in claim 3 wherein said threaded lock-knob is comprised of a security lock.

6. A stabilizing system engageable with a watercraft lift assembly as recited in claim 1 wherein said watercraft lift assembly cradle is supported by said stabilizing beam.

7. A watercraft lift comprising:

a plurality of pilings;

a stabilizing system attached to at least one of said plurality of pilings, the stabilizing system supporting a watercraft lift assembly cradle;

at least one pulley system supported by said plurality of pilings and attached to an upper side of said plurality of pilings;

a security locking device capable of preventing movement of the stabilizing system relative to the attachment of the stabilizing system to said one of said plurality of pilings; and a watercraft cradle supported by said pulley system and attachable to said stabilizing system;

wherein said watercraft cradle is fixedly attached to said stabilizing system;

wherein a threaded fastener fixedly attaches said watercraft cradle to said stabilizing system.

8. A security system for locking a watercraft boatlift comprising:

at least one bracket fixedly attached to a piling, said bracket having a keyhole;

a lateral beam having at least one keyhole pin extending toward said keyhole; and a security device engageable with said keyhole pin, said security device having a security key.

9. A security system as recited in claim 8 further comprising a keypad.

10. A security system as recited in claim 8 further comprising a combination lock.

11. A security system as recited in claim 9 further comprising a combination lock.

12. A security system as recited in claim 8 wherein said security key is an encrypted code.

13. A security system as recited in claim 12 further comprising a combination lock.

* * * * *